US007458907B2

(12) United States Patent
Wang

(10) Patent No.: US 7,458,907 B2
(45) Date of Patent: Dec. 2, 2008

(54) ARTIFICIAL PITCHER FOR PRACTICING THE HITTING SKILL OF BASEBALL

(76) Inventor: Chi-Sung Wang, P.O. Box 697, Fongyuan City 420, Taichung County (TW)

( * ) Notice: Subject to any disclaimer, the term of this patent is extended or adjusted under 35 U.S.C. 154(b) by 89 days.

(21) Appl. No.: 11/715,897

(22) Filed: Mar. 9, 2007

(65) Prior Publication Data

US 2008/0220910 A1 Sep. 11, 2008

(51) Int. Cl.
*A63B 69/00* (2006.01)
*A63B 71/00* (2006.01)
*F41B 7/00* (2006.01)

(52) U.S. Cl. ..... 473/417; 473/451; 473/431; 124/6; 124/16

(58) Field of Classification Search ..... 473/422, 473/417, 423, 428, 451; 124/16, 37, 6
See application file for complete search history.

(56) References Cited

U.S. PATENT DOCUMENTS 2,664,077 A * 12/1953 Moore ..... 124/16
3,612,027 A * 10/1971 Makino ..... 124/16
3,856,300 A * 12/1974 Payne ..... 124/16
5,221,081 A * 6/1993 Rooks ..... 124/16
5,590,876 A * 1/1997 Sejnowski ..... 473/417
5,597,160 A * 1/1997 Mims ..... 124/16
5,848,945 A * 12/1998 Miller et al. ..... 473/417
6,443,859 B1 * 9/2002 Markin ..... 473/451
6,551,204 B1 * 4/2003 Di Re ..... 473/417
6,659,891 B2 * 12/2003 Lloyd ..... 473/429
6,719,649 B1 * 4/2004 Lin ..... 473/417
7,028,682 B1 * 4/2006 Hansen ..... 124/16
2006/0035729 A1 * 2/2006 Wang ..... 473/417

* cited by examiner

*Primary Examiner*—Mitra Aryanpour

(57) ABSTRACT

An artificial pitcher for practicing the hitting skill of baseball includes an artificial pitcher on a support and having a ball holder on top, a main spring biased a stroke which are held by a hook on a hollow interior cylindrical main body, and a control device positioned remote from the pitcher having a rope to control the hook to release the stroke to hit a baseball from the ball holder flying to a batter. In order to pitch a transforming ball, an angular adjustment plate is positioned beside the main body to help the main body to adjust its angle of elevation.

3 Claims, 10 Drawing Sheets

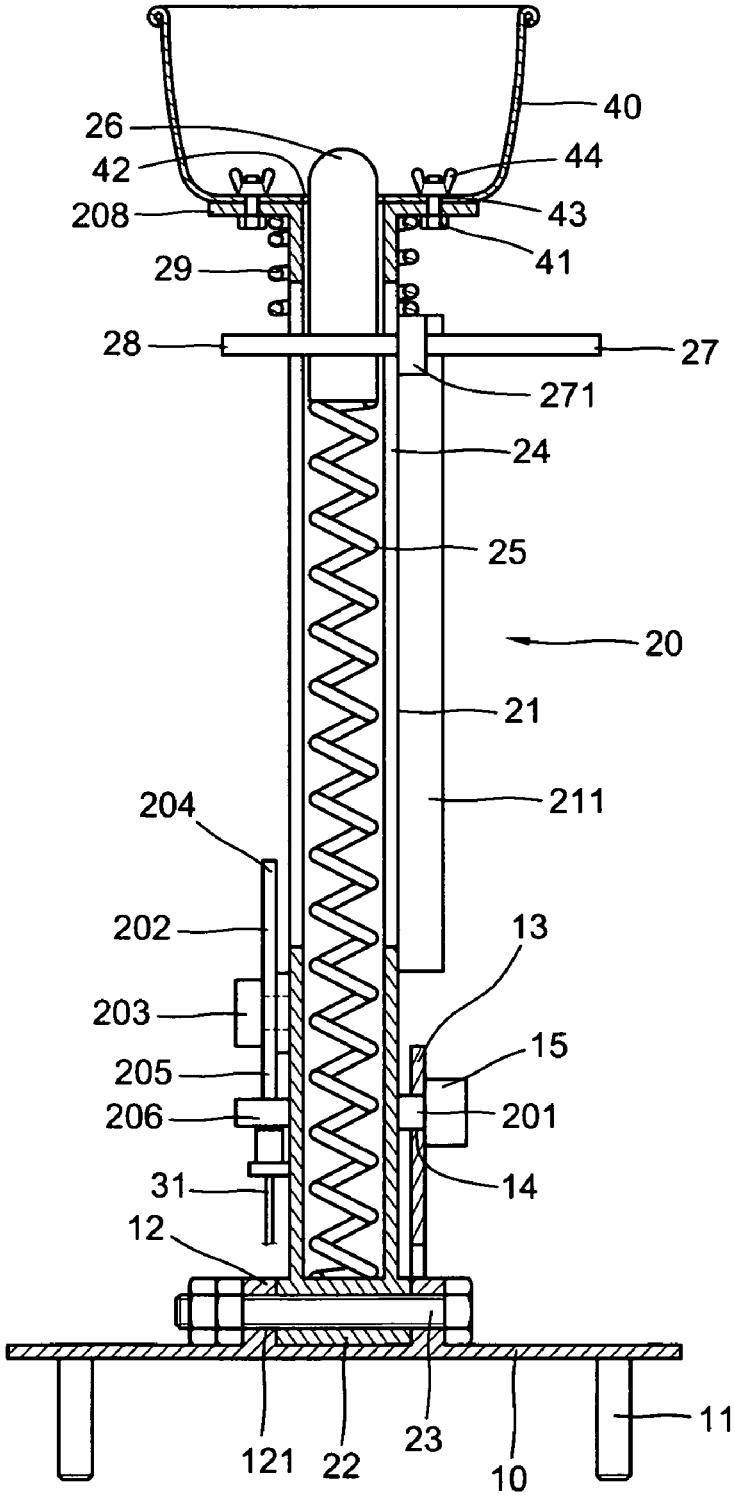
FIG.3
Amended

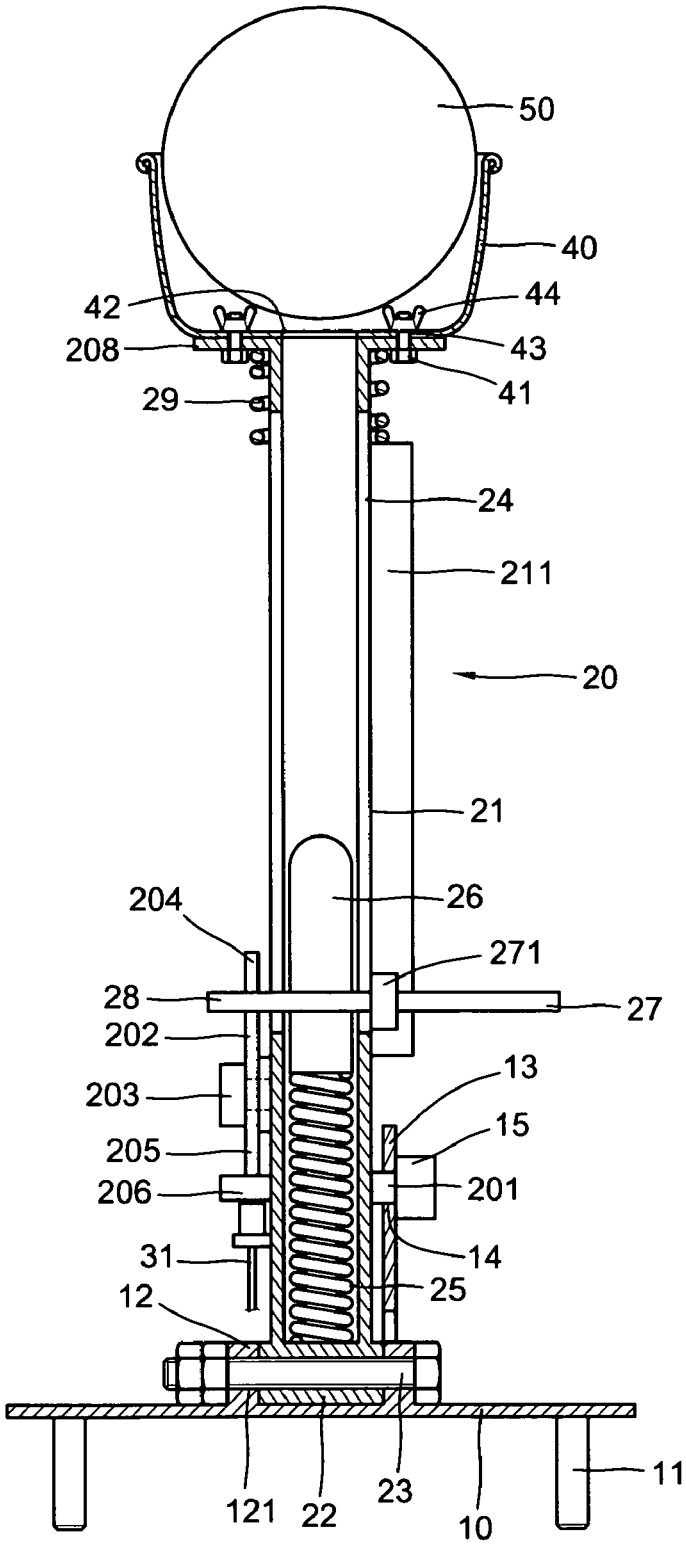
FIG.5
Amended

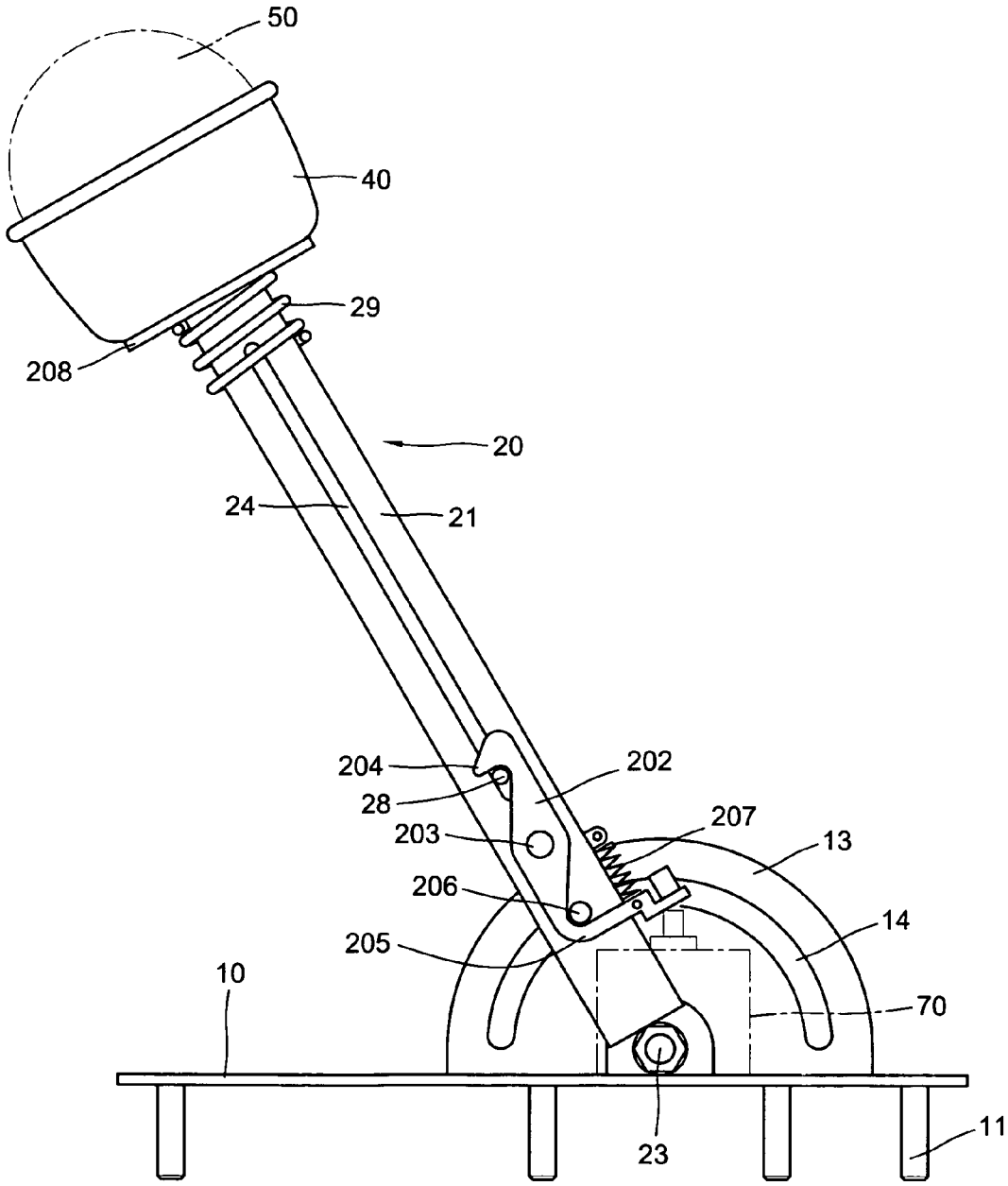
FIG.11
Amended

ARTIFICIAL PITCHER FOR PRACTICING THE HITTING SKILL OF BASEBALL

BACKGROUND OF THE INVENTION

The present invention relates to sports supplies and more particularly to an artificial pitcher for practicing the hitting skill of baseball which facilitates the batter to hit at a predetermined distance and the artificial pitcher pitches along with a parabola or straight line and/or a transforming ball.

The baseball game is one of the group sports. Both the pitcher and the batter must have their basic skills. The whole team must also have the tacit understanding an amateurish batter after having to practice the hitting skill at a business practicing site to practice by paying the fees because he can't have a huge sized automatic pitcher.

So the producer manufactured a handy, portable vertical pitching machine which is able to vertically pitch the ball and the batter has to stand close to the pitcher to hit the ball to practice the batting skill. Due to this pitcher can't pitch the transforming ball, the batter can't improve his batting skill to cope with the real situation. Later, a pitching toy appears in the market. This pitching toy has to be held by hands. So this toy is not better than that pitched by a man.

SUMMARY OF THE PRESENT INVENTION

The present invention has a main object to provide an artificial pitcher for practicing the hitting skill of baseball which can simulately pitch ball along a parabola and adjust the angles of elevation.

Another object of the present invention is to provide an artificial pitcher for practicing the hitting skill of baseball which can pitch the transforming ball and/or the straight ball for improving the batter's hitting skill.

Still another object of the present invention is to provide an artificial pitcher for practicing the hitting skill of baseball which is collapsible and portable easily.

Further object of the present invention is to provide an artificial pitcher for practicing the hitting skill of baseball which enables the batter perform a left or right hitting.

Accordingly, the artificial pitcher of the present invention comprises generally:

a support disposed on the ground, a pitching device pivoted to the top surface of the support, an angle adjustment plate for facilitating the pitching device to adjust the angles of elevation, and having a spring biased a stroke inside the device, a tread rod and a hook on an outer periphery controlled by a small spring, a stopping rod for holding the hook, a baseball holder on the top surface of the pitching device, a control device at a batter place having a tread plate to actuate a rope to release the hook such that the stroke under the resilient force of the spring strokes the baseball from the holder to the batter zone while the batter hits the baseball to practice his hitting skill. The pitcher can serve transforming ball because the baseball holder and the pitcher are adjustable.

The present invention will become more fully understood by reference to the following detailed description thereof when read in conjunction with the attached drawings.

BRIEF DESCRIPTION OF THE DRAWINGS

FIG. 3 is a cross sectional view of FIG. 2;

FIG. 5 is a cross sectional view that a stroke is pressed downward and held by a hook;

FIG. 11 is a plane view to show another alternative arrangement of the control device.

DETAILED DESCRIPTION OF THE PREFERRED EMBODIMENT

Figure 1:
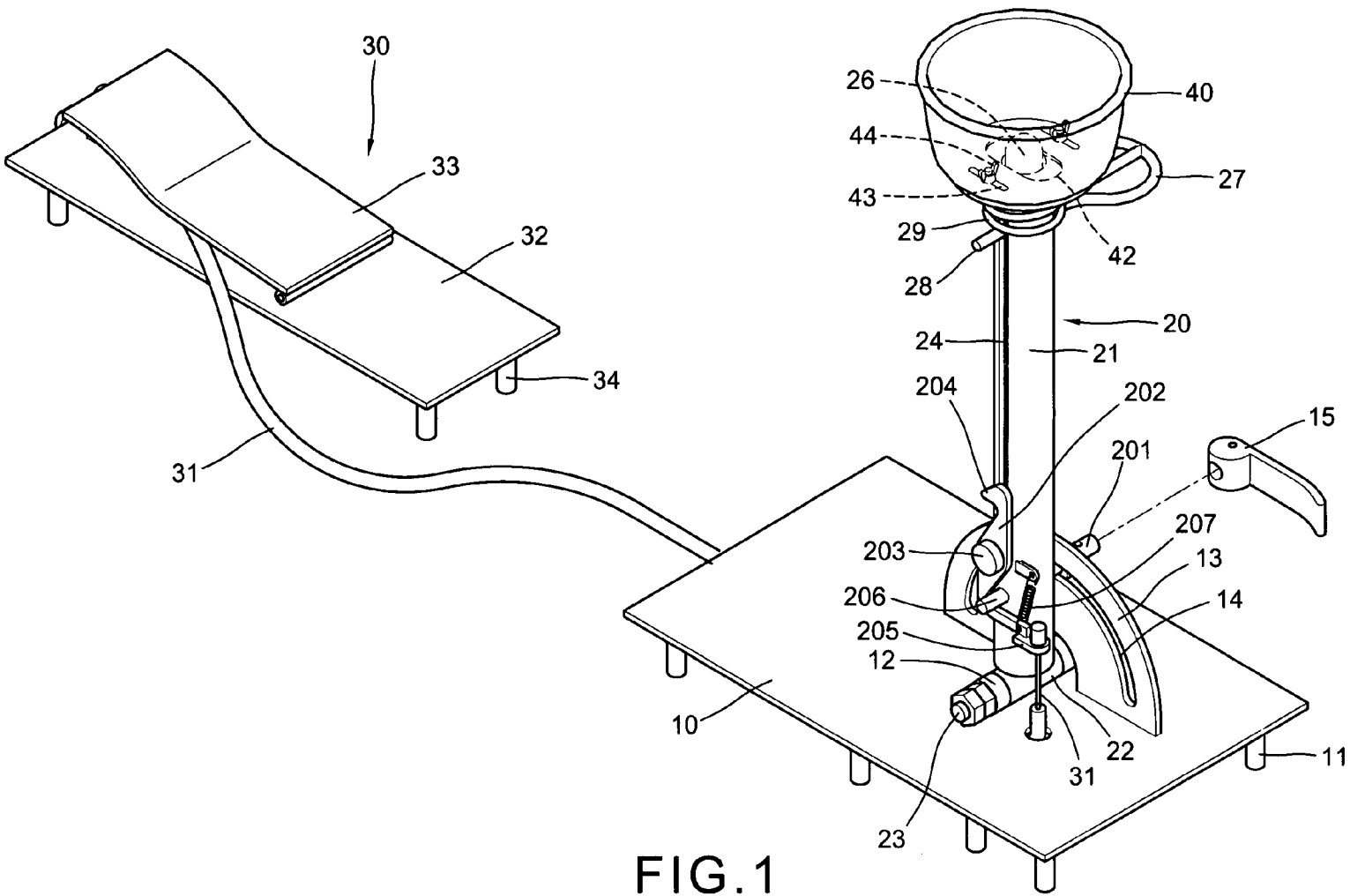
FIG. 1 is a perspective view to show a preferred embodiment of the present invention.
Figure 2:
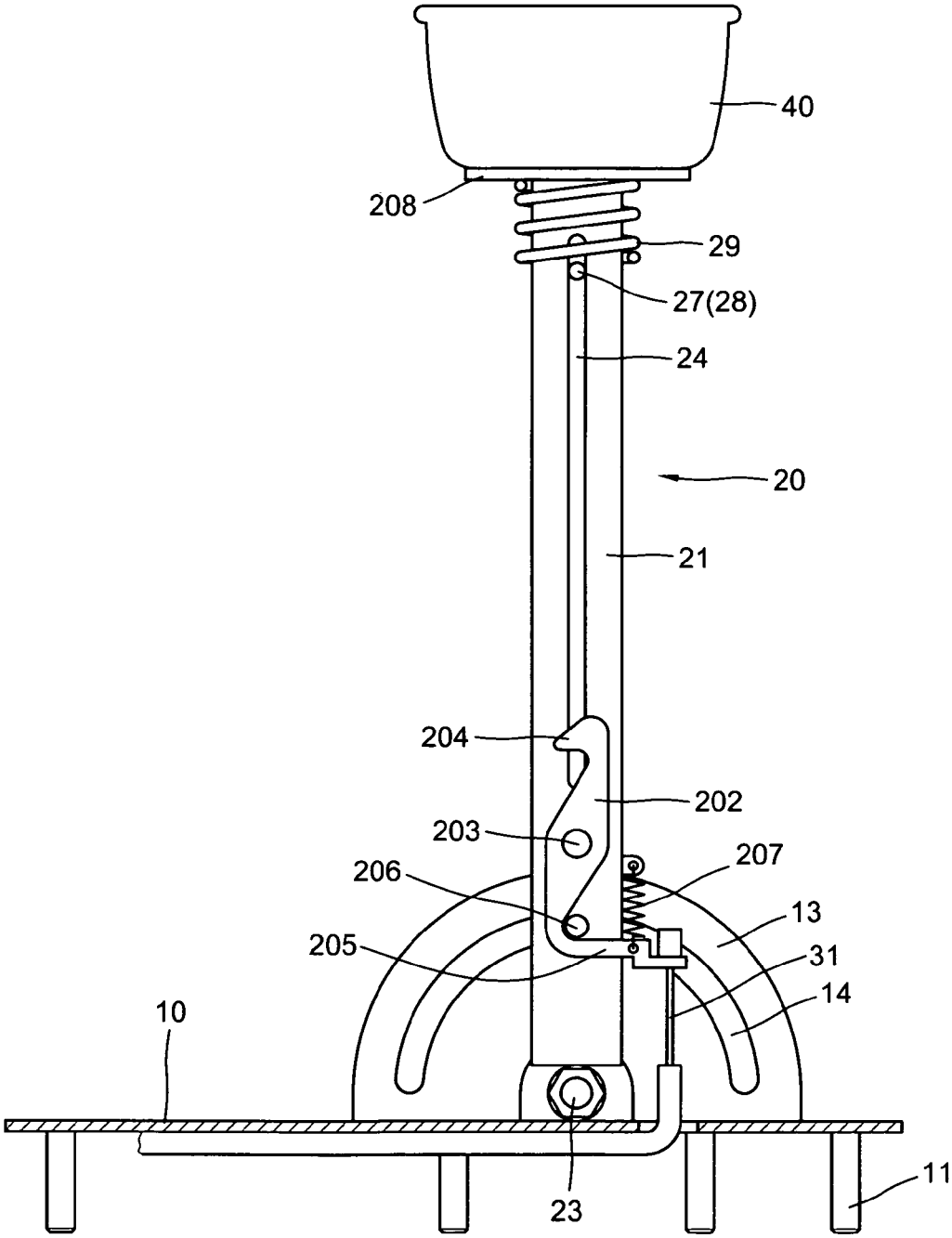
FIG. 2 is a plane view of the artificial pitcher of the present invention.

With reference to FIGS. 1, 2 and 3, a preferred embodiment of the artificial pitcher of the present invention comprises generally a rectangular support 10, an artificial pitcher 20 and a control device 30.

The rectangular support 10 has a plurality of legs 11 secured to an underside of the rectangular support for inserting into a ground, surface; a lug 12 on a top surface of the rectangular support having a pair of aligned through holes 121 (as shown in FIG. 3); a semi-circular angular adjustment plate 13 uprightly disposed on a top surface of the rectangular support abutting the lug 12 and further having an arcuate slot 14 therein and a rope 31 coming from a control device 30.

The artificial pitcher 20 has a hollow cylindrical main body 21 having a transverse tube 22 attached to a lower end engaged within the lug 12 and rotatably secured by a bolt 23; a transverse rod 201 attached to a lower periphery and slidably engaged in the arcuate slot 14 of the semi-circular angular adjustment plate 13, the traverse rod operated by an eccentric handle 15; a stopping rod 206 attached to a lower periphery opposite to the transverse rod 201, a substantially L-shaped hook 202 pivoted to an axle rod 203 and held in place by a stopping rod 206 having a hook head 204 on a top portion, a vertically moved lower end 205 connected to the rope 31 and a spring 207 having a lower end connected to a transverse portion of the L-shaped hook and an upper end connected to a small protrusion on a lower outer periphery of the hollow cylindrical main body 21, a pair of slits 24 in opposing peripheries of the hollow cylindrical main body 21, a main spring 25 biasing a stroke 26 inside the hollow cylindrical main body 21, a tread rod 27 and a catch rod 28 projected outward from opposing peripheries of the stroke 26 and slidabling in the pair of slits 24 respectively; a horizontal plate 208 having a central hole connected to a top portion of the hollow cylindrical main body 21; an outer spring 29 wrapped on an outer periphery of the hollow cylindrical main body 21 biased between the horizontal plate 208 and the tread rod 27; and a ball holder 40 having a central bore engaged with the central hole 42 of the horizontal plate 208 and secured to the horizontal plate 208 by a pair of bolts 41 and a pair of butterfly nuts 44 through the adjustable slots 43; and a guide stripe 211 beside a slit 24 to cope with a bearing 271 of the tread rod 27 for balancing the tread rod 27.

A control device 30 disposed away from the artificial pitcher 20 in a predetermined distance having a rectangular base 32, the base 32 includes a plurality of legs 42 insertible into a ground surface; a tread plate 33 biased by a spring (not shown) on a top surface of the base so the tread plate 33 may conduct a lever activity, a rope 31 having one end connected to an underside of the tread plate 33 and another end connected to the hook of the artificial pitcher 20.

Figure 4:
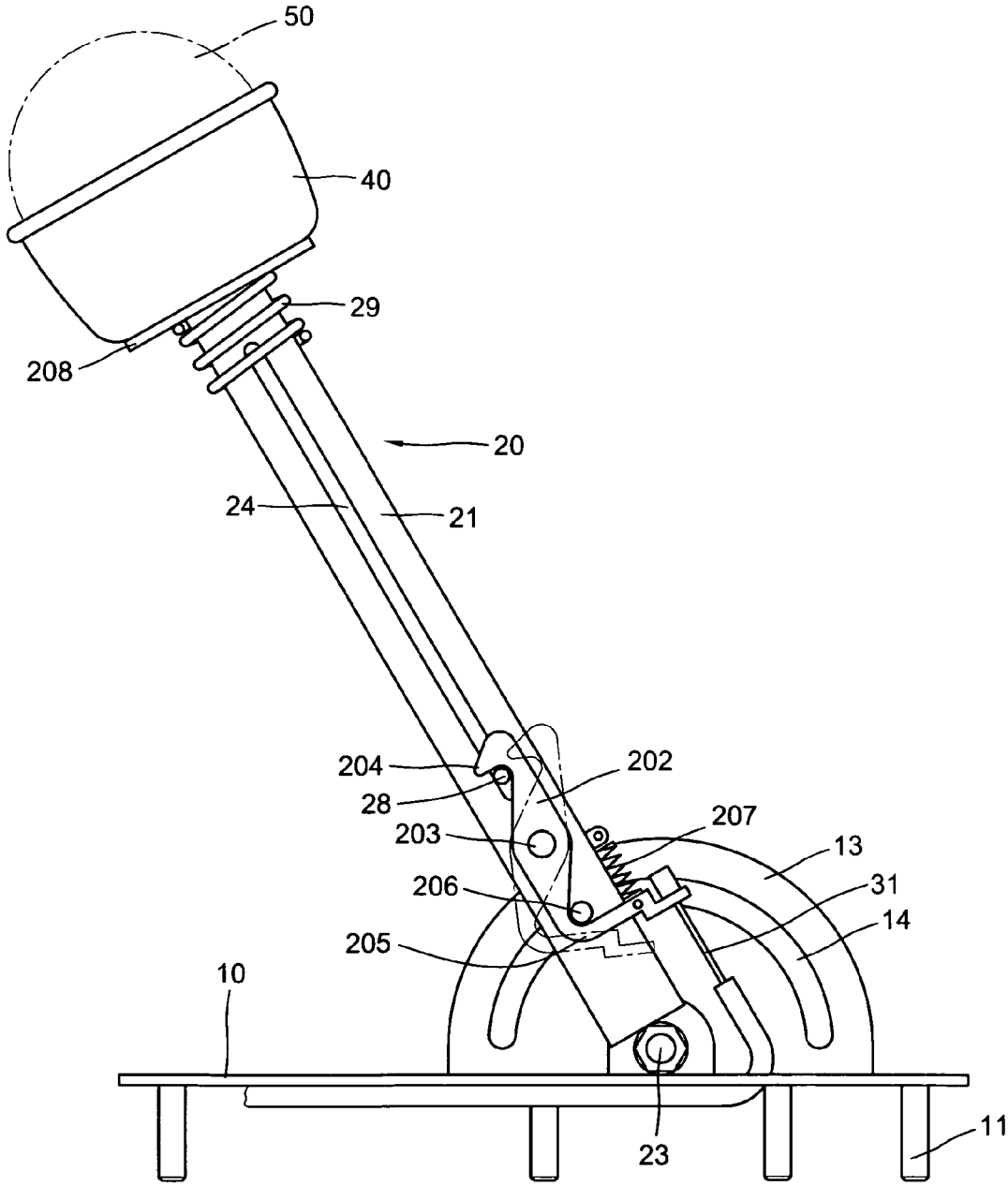
FIG. 4 is a plane view to show that the pitcher is adjusted to a slant angle.
Figure 6:
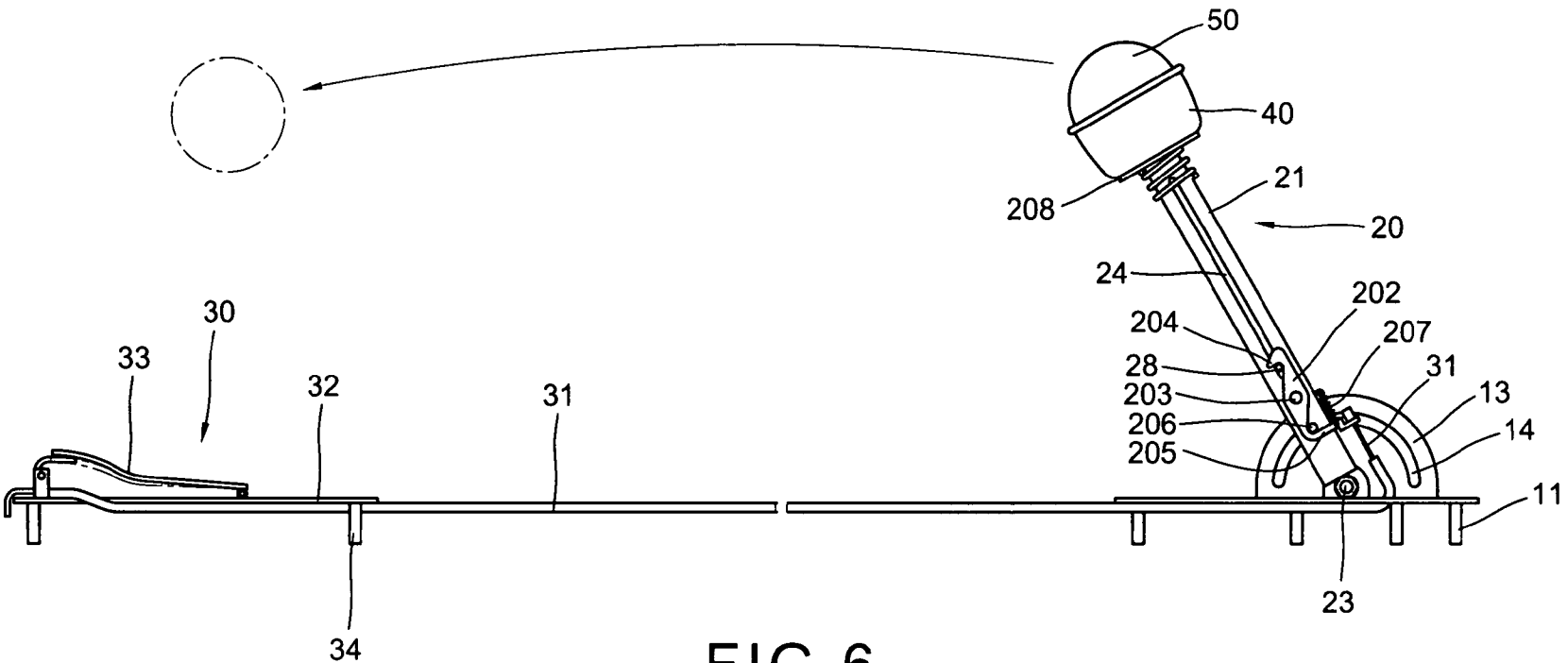
FIG. 6 is a plane view to show that a baseball is pitched and then flies to the batter.

Referring to FIGS. 4, 5 and 6, on the basis of the above discussed structure, in operation, the tread rod 27 is treaded downward until the catch rod 28 reaches the hook 202 while the hook head 204 under the pressure of the catch rod 28 is slightly moved backward and then moved forward to hold the catch rod 28 therein and then a baseball is put into the holder 40 such that the artificial pitcher 20 is ready to pitch. This time the user has to rush to the control device 30 to tread the tread plate 33, the rope 31 becomes tensed to drag the hook 202 to leveredly release the catch rod 28 such that the stroke 26 under the resilience of the spring 25 makes a good stroke to hit the baseball to fly out of holder 40 to the batter who hits the baseball to the field.

The angle of elevation of the artificial pitcher can be adjusted by unfastening the eccentric handle 15 to allow the transverse rod 201 to slide about the arcuate slot 14 of the angular adjustment plate 13 to seek for a predetermined angle of elevation for the artificial pitcher 20 then the eccentric handle 15 is fastened so that the pitcher 20 becomes slant relative to the upper surface of the rectangular support 10.

Figure 7:
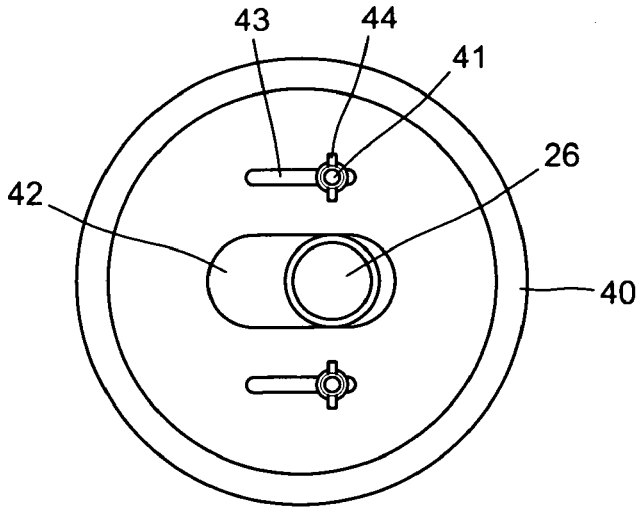
FIG. 7 is a plane view to show the adjustment of a ball holder to one side.
Figure 8:
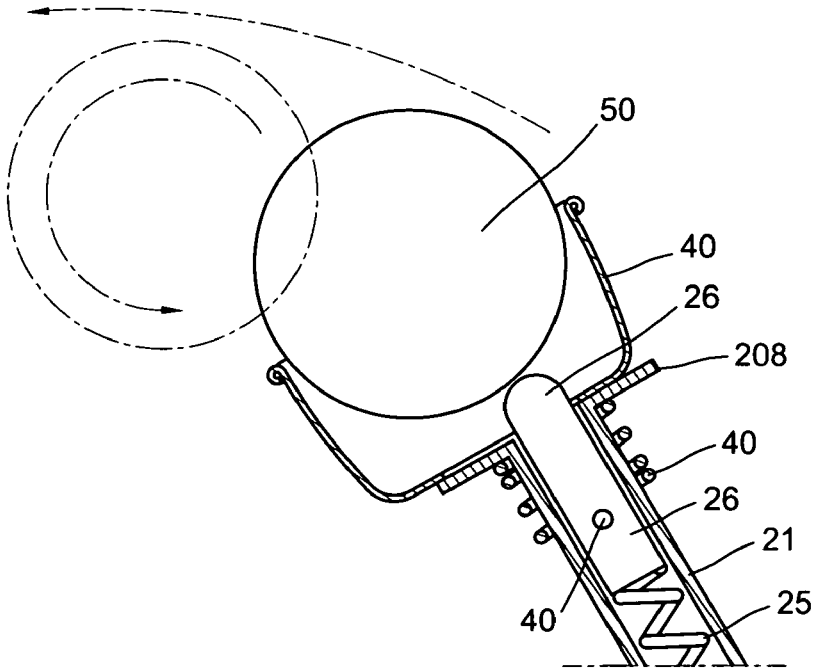
FIG. 8 is a plane view to show that a transforming ball is pitched upward.

Normally, the stroke 26 strikes the center of the baseball 50 which is flying along a parabola line without rotation. This is so called a normal pitching. If unfastening the butterfly nut 44 and displacing the ball holder 40, and then fastening the butterfly nut 44, the baseball 50 inside the ball holder becomes eccentric (as shown in FIGS. 7 and 8). This time, the stroke 26 strikes a side of the baseball 50 which becomes rolling and the baseball 50 flies in a transforming manner.

This artificial pitcher is portable if sliding the pitcher 20 close to the rectangular support 10. Because of its simple structure, the artificial pitcher is easy to be collapsed, maintained and displayed so it is durable.

Figure 9:
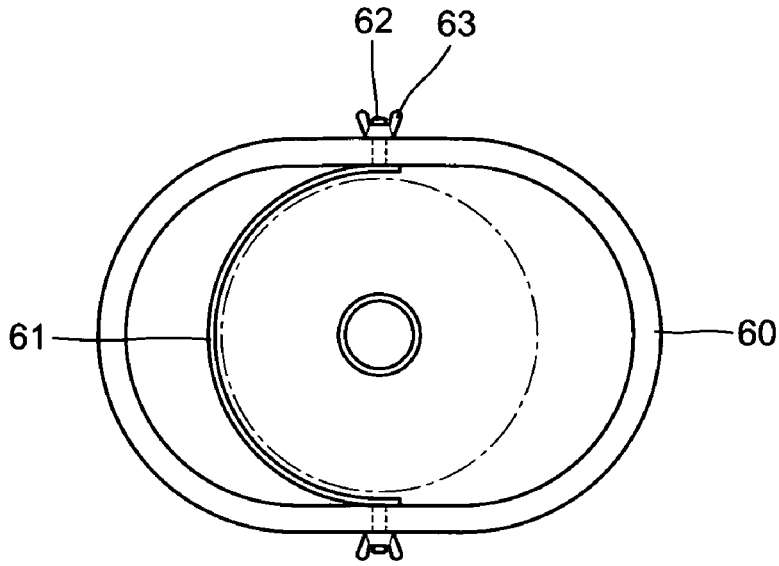
FIG. 9 is a plane view to show an alternate arrangement of the ball holder.
Figure 10:
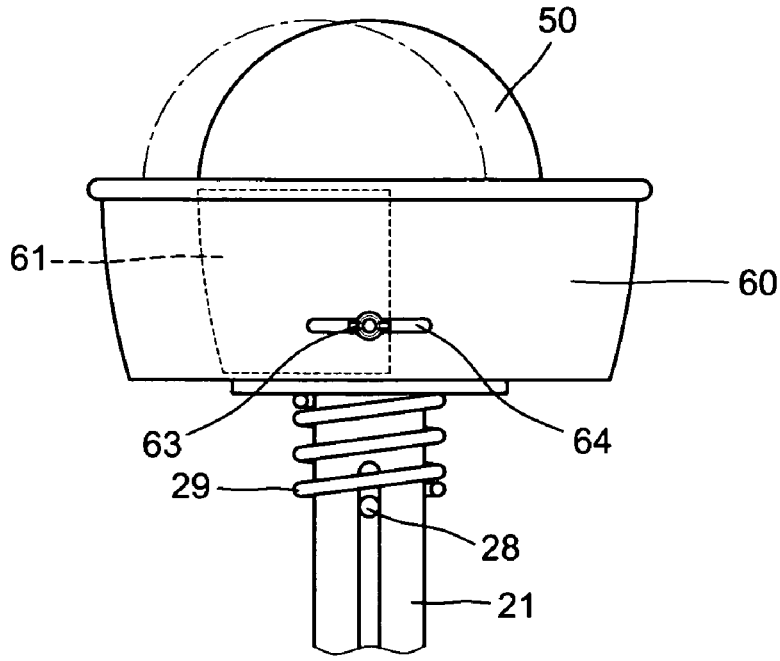
FIG. 10 is a side view of FIG. 9.

Referring to FIGS. 9 and 10, an alternate ball holder 60 is provided. This ball holder 60 has a pair of positioning transverse slots 64 spacedly formed in opposing peripheries for alternately positioning a roughly U-shaped displacement plate 61 by a pair of butterfly headed bolts 63 by which the baseball 50 can be put at the center of the ball holder 60 or at one side of the holder 60.

FIG. 11 provides another alternate arrangement which adopts for an electric appliance 70 instead of the control device 30. The electric appliance 70 may be a motor or an electronic switch which has a projection on the top surface to actuate the hook 202 to hold or to release the stroke 26 as being operated by the rope 31. To operate the electric appliance 70, the batter may hold a remote sensor on hand.

Figure 12:
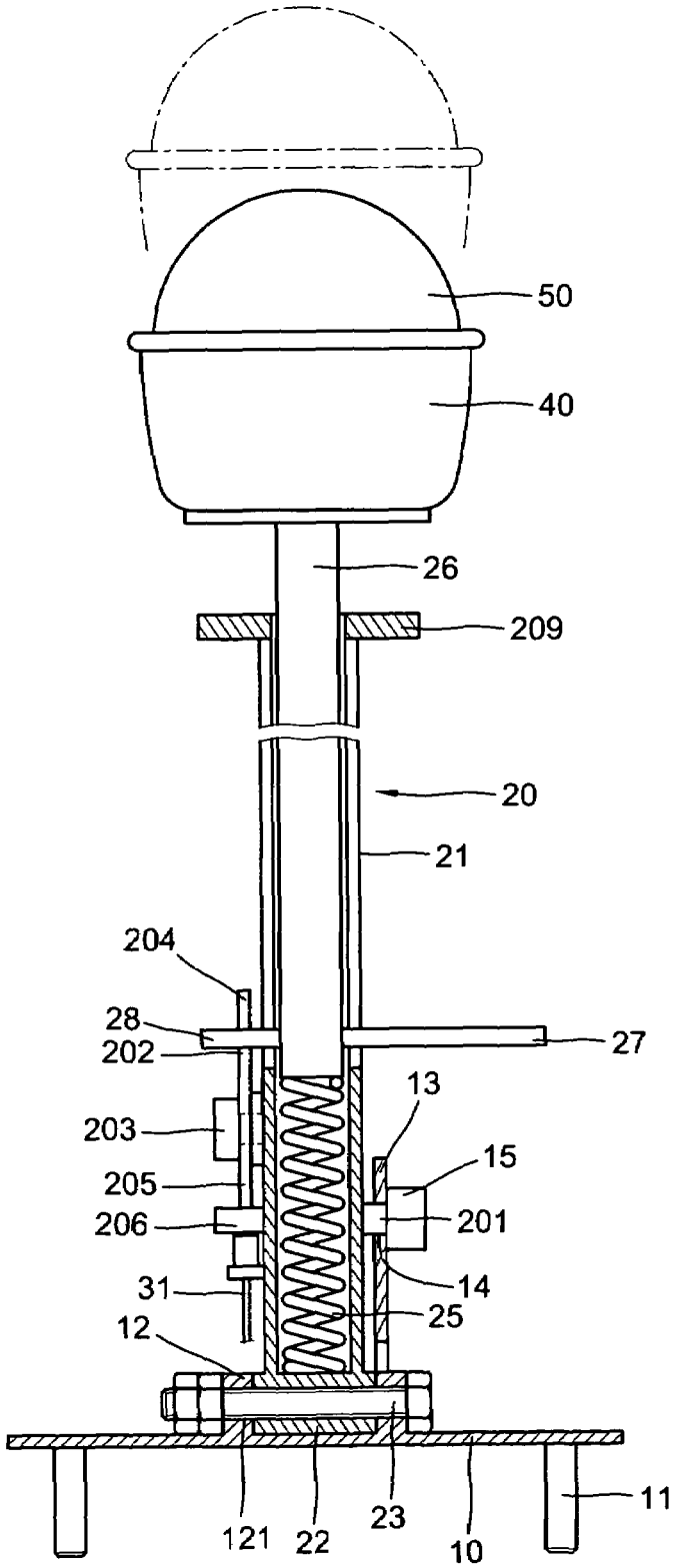
FIG. 12 is a cross sectional view to show a change of the main spring from the hollow cylindrical body.

Referring to FIG. 12, when changing the main spring 25, in order to prevent the spring 25 from injuring people, the stroke 26 may directly stretch upward and the ball holder 40 directly fixes to the top surface of the stroke 26, the hollow cylindrical main body 21 has a stop ring 209 which is elastic and stops the ball holder 40 from downward movement. By utilizing the upper resilient force, the user pitches the baseball 50 from the ball holder, safely changing the spring 25.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. An artificial pitcher for practicing the hitting skill of baseball comprising:

a rectangular support having a plurality of legs secured to an underside of the rectangular support for inserting into a ground surface;

a lug secured on a top surface of the rectangular support including a pair of aligned holes;

a semi-circular angular adjustment plate uprightly disposed on a top surface of the rectangular support abutting the lug and further including an arcuate slot;

an artificial pitcher having a hollow cylindrical main body having a transverse tube attached to a lower end engaged within said lug and rotatably secured by a bolt;

a transverse rod attached to a lower periphery and slidably engaged in the arcuate slot of said semi-circular adjustment plate, the transverse rod operated by an eccentric handle, a stopping rod attached to a lower periphery opposite to the transverse rod, a substantially L-shaped hook attached on the lower periphery and held in place by a slopping rod having a small spring connected to a transverse portion of the L-shaped hook and a small projection, the small projection having a hook head on a top portion and a plane portion at an outer end of a transverse portion;

a pair of slits placed in opposing peripheries of the hollow cylindrical main body, a main spring biasing a stroke inside the hollow cylindrical main body;

a tread rod and a catch rod projected outward from opposing peripheries of said stroke and sliding in the pair of slits respectively;

a horizontal plate including a central hole connected to a top portion of the hollow cylindrical main body; an outer spring wrapped on an outer periphery of the hollow cylindrical main body biased between the horizontal plate and the tread rod;

a ball holder attached to the top portion of the hollow cylindrical main body having a central bore engaged with the central hole of the horizontal plate and a pair of slots formed within the horizontal plate for receiving a pair of bolts and butterfly nuts, and a guide stripe beside a slit to cope with a bearing of the tread rod for balancing the tread rod;

a control device positioned away from the artificial pitcher having a rectangular base, the base including a plurality of legs insertible into a ground surface; a tread plate biased by a spring on a top surface of the base and a rope having one end connected to an underside of the tread plate and another end connected to the hook of said artificial pitcher.

2. The artificial pitcher as recited in claim 1, further including an alternate ball holder having a pair of transverse positioning slots respectively formed in opposing peripheries for positioning a U-shaped displacement plate fastened by a pair of butterfly headed nuts through said transverse positioning slots.

3. The artificial pitcher as recited in claim 1, wherein the control device is an electric appliance having a projection on top portion for actuating the hook of said hollow cylindrical main body of said artificial pitcher.

* * * * *